United States Patent [19]

Kidowaki

[11] 4,357,706

[45] Nov. 2, 1982

[54] ARC GENERATING ELECTRIC SYSTEM FOR A METAL CASTING APPARATUS

[75] Inventor: Yoshimasa Kidowaki, Hommachi, Japan

[73] Assignee: Iwatani Sangyo Kabushiki Kaisha, Osaka, Japan

[21] Appl. No.: 170,930

[22] Filed: Jul. 21, 1980

[51] Int. Cl.[3] ..... H05B 7/148

[52] U.S. Cl. ..... 373/104

[58] Field of Search ..... 13/12; 219/130.4; 373/104, 102, 105

[56] References Cited

U.S. PATENT DOCUMENTS 4,123,646 10/1978 Keinanen ..... 219/130.4 X

*Primary Examiner*—Roy N. Envall, Jr.

*Attorney, Agent, or Firm*—Bacon & Thomas

[57] ABSTRACT

An arc generating electric system includes a first high-tension d.c. supply, electrodes and a high-voltage rectifier, the electrodes and the rectifier being connected in series, wherein the rectifier is in a forward position with respect to the first d.c. supply, and the arc generating system additionally includes a second high-tension d.c. supply connected in parallel to the rectifier, the second d.c. supply being in a forward position with respect to the first high-tension d.c. supply.

1 Claim, 12 Drawing Figures

ARC GENERATING ELECTRIC SYSTEM FOR A METAL CASTING APPARATUS

BACKGROUND OF THE INVENTION

1. Field of the Invention

The present invention relates to an arc generating electric system adapted for use in a metal casting apparatus, and more particularly, to an arc generating electric system adapted for a metal casting apparatus in which system a high-tension d.c. voltage is employed to generate an electric arc for obtaining a molten metal to be cast in the mold.

2. Description of the Prior Art

It is known in the art to employ electric arc discharges for obtaining a molten metal to be cast in a mold, but it has been found difficult to maintain the electric arc long enough to melt the material under the inert gas atmosphere, because under this atmosphere the gap between two electrodes must be enlarged (e.g. 5 to 10 mm) so as to produce an adequate amount of heat. However, it has proved to be difficult to generate an effectively continuous electric arc in such a large electrode gap.

In order to overcome the difficulty it has been proposed to employ a high-frequency voltage for generating an electric arc. However, the following disadvantages have been encountered:

(1) The polarities of the electrode and the material are continuously reversed as is to be expected from an A.C. current generator, and the electric arc dissipates after a single arcing, thereby failing to generate a continuous electric arc. As a result, it is impossible to enlarge the gap between the electrode and the material, (2) In order to obtain an enlarged gap, a highly intensified high-frequency voltage can be employed, but it requires sufficient insulation. This results in a large-scale, expensive apparatus, and;

(3) A high-frequency wave may occur, which is likely to invade a power supply and/or to cause an aerial disturbance in the circumstance.

The present invention is directed toward solving the difficulties and disadvantages mentioned above, and has for its object to provide an improved arc generating electric system adapted for use in a metal casting apparatus, wherein the electric system permits the employment of a high-tension d.c. current to maintain the electric arc in effect regardless of a relatively large gap between two electrodes.

Other objects and advantages of the present invention will be obvious to one skilled in the art from the following description.

SUMMARY OF THE INVENTION

According to the present invention an arc generating electric system includes a first high-tension d.c. supply, electrodes and a high-voltage rectifier, the electrodes and the rectifier being connected in series, wherein the rectifier is in a forward position with respect to the first d.c. supply, and the arc generating electric system additionally includes a second high-tension d.c. supply connected in parallel to the rectifier, the second d.c. supply being in a forward position with respect to the first high-tension d.c. supply.

DETAILED DESCRIPTION OF THE INVENTION

Figure 2:
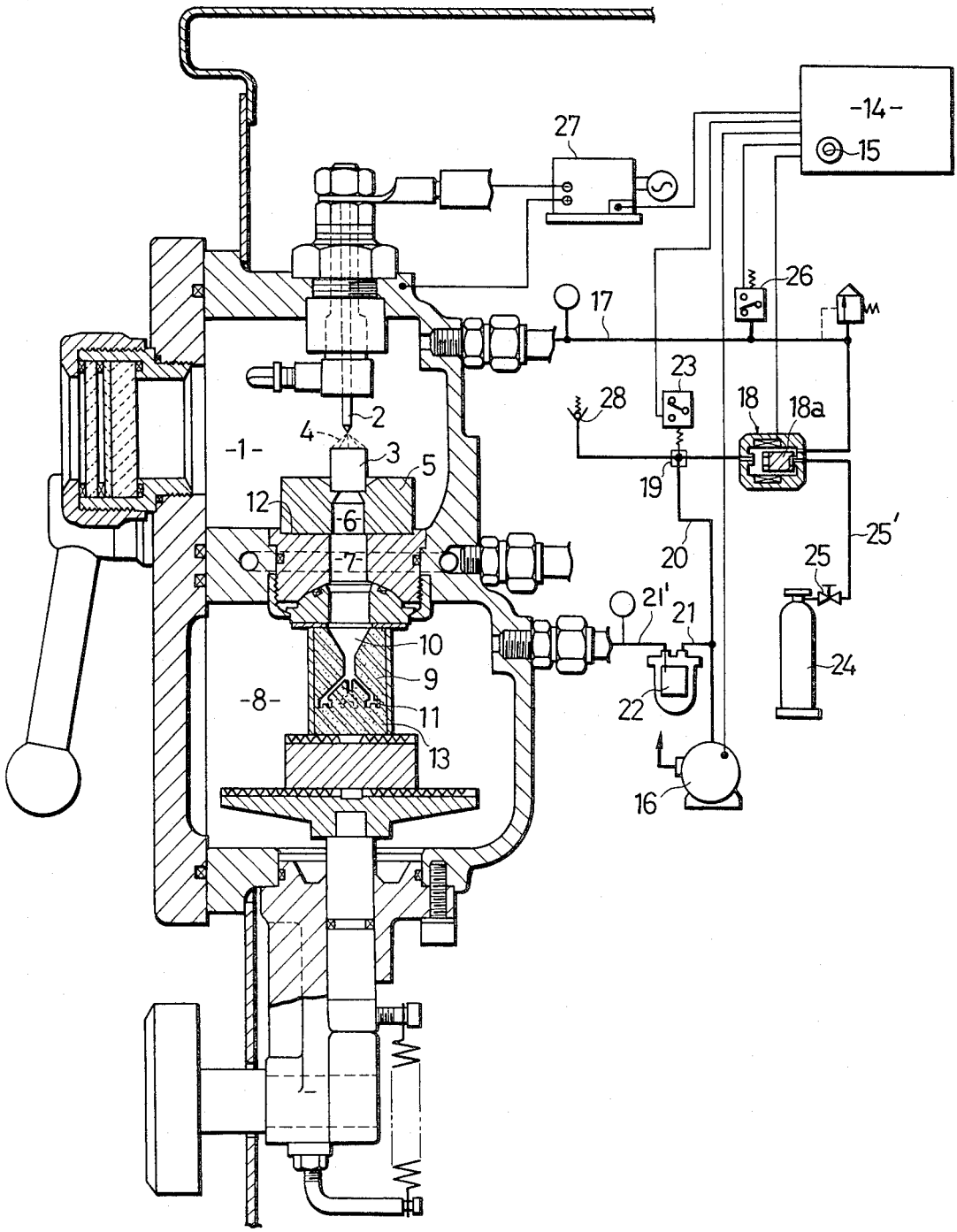
FIG. 2 is a vertical cross-section through the metal casting apparatus in FIG. 1.

In FIG. 2 the overall structure of a metal casting apparatus is shown, whose notable basic structure consists of a heating chamber 1 located in the center in which an electric arc 4 is produced between an electrode 2 and a material 3 placed in a crucible 5.

Figure 1:
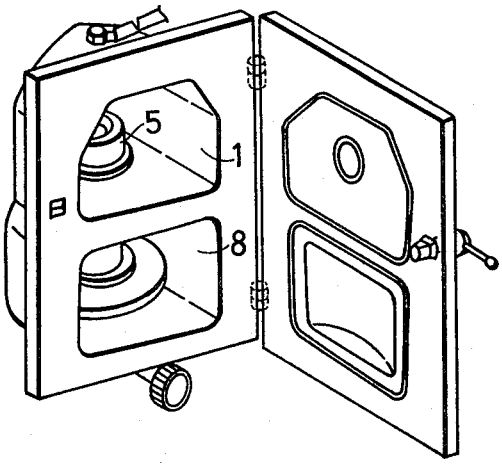
FIG. 1 is a perspective view of a metal casting apparatus.
Figure 3:
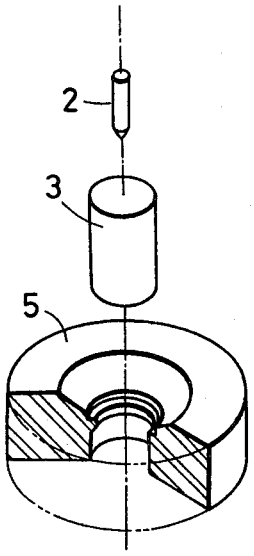
FIG. 3 is an analytical perspective view on an enlarged scale of the crucible, the material and the electrode seen in FIG. 2.
Figure 4:
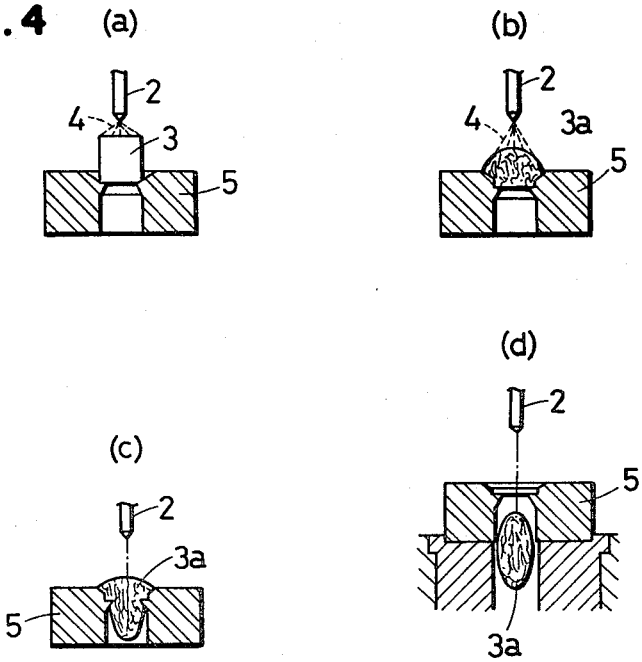
FIGS. 4 (*a*) to (*d*) show each aspect of the production of a molten metal in a crucible.

As shown in FIGS. 4 (*a*) to (*d*) the material melts from its top portion to its bottom portion, and gradually fills the crucible 5. When it completely becomes fluid the molten material flows down through an outlet 6 in the bottom of the crucible, and passes into a molding chamber 8 through a pouring path 7. In the molding chamber 8 the molten material 3a enters cavities 11 in a mold 9 through an inlet 10.

The heating chamber 1 and the molding chamber 8 are filled with an inert gas, such as argon, so as to avoid a possible oxidizing or any other degrading of the material. In this case, it is adjusted so as to produce a pressure difference of about 3.75 $Kg/cm^2$ between the heating chamber and the molding chamber, thereby producing a gaseous stream from the heating chamber to the molding chamber. As a result, the flow of the molten material accelerates under the gaseous stream. In this way the molten material can deeply and extensively reach every corner of the cavities 11.

In order to secure the inert gas stream in the described manner, both the chambers 1 and 8 are subjected to air evacuation by means of a pump 16 operable through a sequence controller 14 operated by a push button 15. When the air in each chamber 1 and 8 is withdrawn, and when the pressure in each chamber reaches $-0.7$ $Kg/cm^2$, the evacuation for the heating chamber 1 is automatically stopped through a vacuum-responsive switch 23. The air in chamber 1 is withdrawn via pipes 17 and 20 connected with the chamber 1 and the vacuum pump 16, respectively, and connected with each other by a three-way shuttle valve 18 and a coupler 19. Similarly, air is withdrawn from the molding chamber 8 through a pipe 21' and a strainer 22 and, via pipe 21, to a connection with pipe 20. Then the heating chamber 1 is filled with an inert gas, such as argon, until its pressure reaches 3 $Kg/cm^2$ as determined by the regulator 25. The inert gas is supplied from a container 24 and is then introduced under pressure into the heating chamber 1 via a regulator 25 and a pipe 25' connected to the shuttle valve 18. On the other hand, the evacuation in the molding chamber 8 is continued until the molding process is completed. When the molding is finished, the sequence controller 14 functions to stop operation of the vacuum pump 16 and the piston 18a of the three-way shuttle valve 18 is then biased to the right, as shown in FIG. 2, by means of any suitable biasing means (not shown). In this manner, both the air evacuation of the molding chamber 8 and the introduction of the inert gas into the heating chamber 1 is stopped. The inert gas remaining in the chamber 1 is drained to the atmosphere via the pipe 17, the shuttle valve 18, the coupler 19 and a check valve 28. The inert gas is partially withdrawn into the molding chamber 8 via the pipes 20 and 21' whereby atmospheric pressure is restored in both of the chambers 1 and 8. When the inert gas pressure reaches 0.5 $Kg/cm^2$ in the heating chamber 1, a pressure-responsive switch 26 is automatically operated to energize an arc maintaining circuit 27 and to initiate an electric arc discharge 4 between the electrode 2 and the material 3.

When the material melts and becomes fluid, the air evacuation and the introduction of an inert gas are stopped for the molding chamber 8 and the heating chamber 1, respectively. The inert gas in the heating chamber 1 is partially led to the molding chamber 8 in a stream as described above. The remaining inert gas therein is allowed to escape into the atmosphere. In this way the atmospheric pressure is restored throughout the heating chamber and the molding chamber. At this stage the molding is finished.

Figure 5:
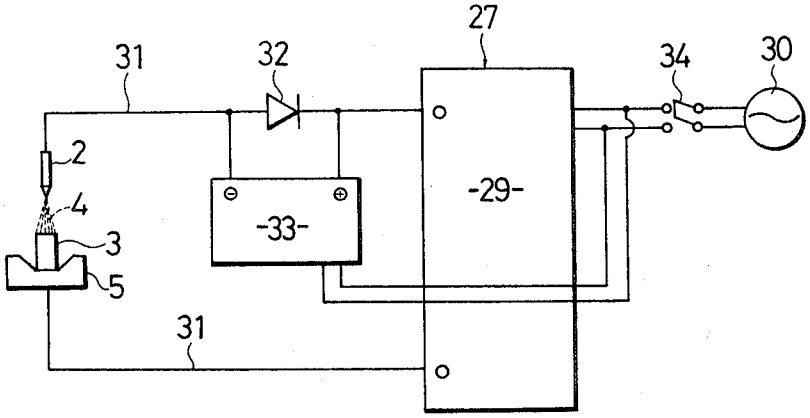
FIG. 5 is an electric diagram of the arc generating circuit according to the present invention.

Referring now to FIG. 5, the arc maintaining circuit 27 includes a main d.c. supply 29 which secures a high-tension d.c. current by converting an a.c. current from a commercial a.c. supply 30. The high-tension d.c. current is applied to an output circuit 31 which includes the arc generating electrodes (i.e. the electrode 2 and the material 3) and a high-voltage rectifier 32 in series, wherein the material 3 is electrically connected to the positive of the main d.c. supply 29 while the electrode 2 is electrically connected to the negative thereof. The rectifier 32 is at the forward position to the main d.c. supply 29. In parallel to the rectifier 32, an arc generating d.c. supply 33 is connected, which is at a forward position with respect to the main d.c. supply 29. The arc generating d.c. supply 33 also secures a high-tension d.c. current by converting an a.c. current from the commercial a.c. supply 30, and applies it to the output circuit 31.

In operation, a starter 34 is switched on, and the a.c. current from the commercial a.c. supply 30 is converted into high-tension d.c. currents at the main d.c. supply 29 and the arc generating d.c. supply 33, respectively. Both the high-tension d.c. voltages are applied to the output circuit 31 simultaneously at the same polarity. In this way the low-intensity d.c. current of high voltage from the arc generating d.c. supply 33 initiates the generation of arc discharges between the electrode 2 and the material 3. Once an electric arc has been ignited, the output circuit 31 is closed for the d.c. supply 33, and the electric arc is maintained with the high-intensity d.c. current of high voltage from the main d.c. supply 29. In this way the electric arc is maintained at a high energy, thereby causing the material 3 to melt quickly.

As described above, the arc igniting voltage is a d.c. current constantly with the electrode 2 at the negative polarity and the material 3 at the positive polarity, and molecules of an inert atmospheric gas are accelerated continuously from an electrode to the material to be treated. Once ionization has taken place, it continues to develop and extend between the electrodes. Thus the electric arc is maintained for an effectively long time.

Figure 6:
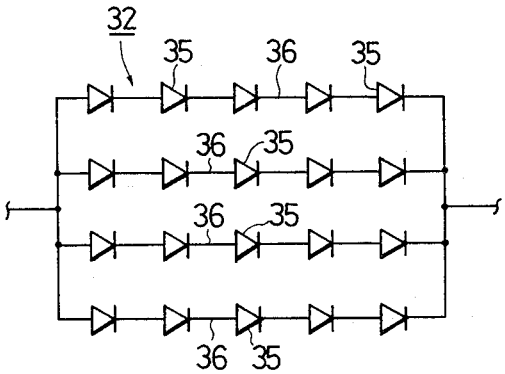
FIG. 6 is an electric diagram showing a modified version of the high-voltage rectifier in FIG. 5.

The present invention has been so far described with respect to only one embodiment, but it is understood that the same is not limited thereto but is susceptible of various changes and modifications as known to one having ordinary skill in the art, as follows:

(A) As shown in FIG. 6, the rectifier 32 can be constructed with a plurality of unit lines 36 including several low-voltage, low-current rectifiers 35 in series, wherein the unit lines are connected in parallel. In this embodiment an ordinary rectifier available in the market can be employed, which saves the production cost.

Figure 7:
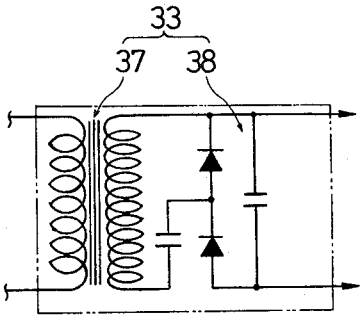
FIG. 7 is an electric diagram showing a modified version of the arc igniting high-tension d.c. supply in FIG. 5.

(B) As shown in FIG. 7, the arc generating d.c. supply 33 is provided with a booster transformer 37 whose second coil has a voltage multiplier rectifier circuit 38. In this embodiment the d.c. supply 33 is economically produced because of its simplified structure.

Figure 8:
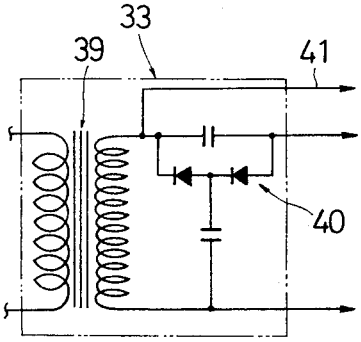
FIG. 8 is an electric diagram showing a further modified version of the arc igniting high-tension d.c. supply.

(C) As shown in FIG. 8, the arc generating d.c. supply 33 is provided with a booster transformer 39 whose secondary coil has a voltage multiplier rectifier circuit 40 and an a.c. circuit 41, wherein the rectifier circuit and the a.c. circuit are connected in parallel, whereby an unrectified a.c. current is overlaid to the voltage-multiplied d.c. current. In this embodiment the peak voltage can reach high values, thereby initiating the ionization readily. As a result, an electric arc can take place at a relatively low voltage.

(D) In the electric circuit as shown in FIG. 8, the a.c. circuit 41 can be dispensed with.

Figure 9:
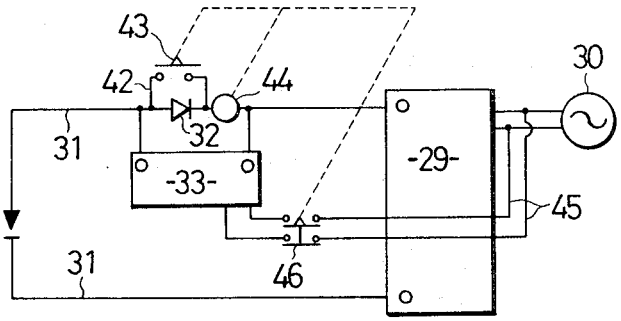
FIG. 9 is an electric diagram showing the main section of a further embodiment of the arc generating circuit.

(E) As shown in FIG. 9, a short circuit 42 is additionally connected in parallel to the rectifier 32, wherein the short circuit includes a normally opened switch 43. The switch 43 is closed by a relay 44 connected in series to the rectifier 32. When the electric arc has been ignited, the main d.c. supply 29 is energized to apply a d.c. current to the output circuit 31, thereby causing the relay 44 to close the switch 43. As a result, the rectifier 32 is protected against an unnecessary load which otherwise would continue to apply thereto. Accordingly, the life of the rectifier 32 will be prolonged, and the rectifier to be used can be small-sized. In addition, the line is advantageously safe from voltage drop during the inoperative period of the rectifier 32. This results in the power-saving as well as the increased melting efficiency.

In addition, the arc generating d.c. supply 33 is provided with a normally closed switch 46 in its input circuit 45, wherein the switch 46 is opened by the relay 44. In this way, when the switch 43 for the short circuit 42 is closed by the relay 44, the switch 46 is opened, thereby deenergizing the d.c. supply 33 immediately after the electric arc ignites.

As evident from the foregoing, a d.c. current is employed for generating electric arc between the electrodes 2 and 3, which means that each polarity of the electrodes are constantly the same. As a result, the ionization continues to develop and extend therebetween in accordance with the unilateral transmission of electrons from the electrode 2 to the material 3. Owing to the extended column of ionization, the electric arc is maintained long enough regardless of the relatively large gap between the electrodes. This is particularly advantageous when the material to be melted has a high melting point, in which a large amount of heat is required. In this embodiment, however, such a material can be readily melted at the heat produced in the large gap between the electrodes. The initiation and maintenance of the electric arc can be performed initially by switching on the starter, and all the subsequent procedures automatically follow.

The electric arc is maintained at its stable state, and the trouble of adjusting the gap between the electrodes can be saved. The electric arc is generated with a high-tension d.c. current, and a high-frequency current is not employed. This avoids problems likely to be caused by high-frequency currents, such as aerial disturbance.

What is claimed is:

1. An arc generating electrical system adapted for use in an inert gas atmosphere metal casting apparatus, which system comprises:

a first high-tension d.c. supply having an output circuit in which arc generating electrodes and a high voltage rectifier are connected in series;

said high-voltage rectifier being at the forward position with respect to said first d.c. supply;

a second high-tension d.c. supply connected in parallel to said high-voltage rectifier;

said second d.c. supply being at the forward position with respect to said first d.c. supply; and, said high-voltage rectifier having a short circuit in parallel therewith, wherein said short circuit has a switch closable so as to complete said short circuit while said first d.c. supply applies voltage to its output circuit in an unpulsed and continuous manner and, a relay is connected in series to said high voltage rectifier so as to close said switch when said relay is energized and to simultaneously shut off said second d.c. supply.

* * * * *